United States Patent [19]

Jayne et al.

[11] Patent Number: 4,598,672

[45] Date of Patent: Jul. 8, 1986

[54] APPARATUS FOR STABILIZING THE POSITION OF A YOKE IN AN INTERNAL COMBUSTION ENGINE

[75] Inventors: Michael E. Jayne; Robert B. Gray, both of Belchertown, Mass.

[73] Assignee: R P & M Engines, Amherst, Mass.

[21] Appl. No.: 699,217

[22] Filed: Feb. 6, 1985

Related U.S. Application Data

[63] Continuation-in-part of Ser. No. 614,475, May 29, 1984, abandoned.

[51] Int. Cl.[4] ..... F02B 75/28

[52] U.S. Cl. ..... 123/56 BC; 123/197 AC

[58] Field of Search ..... 123/56 R, 56 B, 56 BC, 123/56 C, 197 R, 197 AC, 78 R, 78 E, 78 F

[56] References Cited

U.S. PATENT DOCUMENTS

| | | | |
|---|---|---|---|
| 750,336 | 1/1904 | Bentz | 123/197 R |
| 763,742 | 6/1904 | Emerson | 123/197 AC |
| 842,246 | 1/1907 | Rice | 123/197 R |
| 1,205,895 | 11/1916 | Hoyt | 123/197 R |
| 1,349,660 | 8/1920 | Buhl | 123/197 AC |
| 1,505,856 | 8/1924 | Briggs | 123/197 AC |
| 1,687,425 | 10/1928 | Briggs | 123/197 AC |
| 1,774,105 | 8/1930 | Neldner | 123/56 BC |
| 1,835,096 | 12/1931 | Schwarz | 123/78 E |
| 2,132,595 | 10/1938 | Bancroft | 123/56 BC |
| 2,184,820 | 12/1939 | Tucker | 123/56 BC |
| 2,290,202 | 7/1942 | Nelson | 123/56 BC |
| 4,013,048 | 3/1977 | Reitz | 123/56 BC |
| 4,449,494 | 5/1984 | Beaudoin | 123/197 AC |

FOREIGN PATENT DOCUMENTS

| | | | |
|---|---|---|---|
| 996734 | 2/1983 | U.S.S.R. | 123/197 AC |

*Primary Examiner*—Craig R. Feinberg
*Attorney, Agent, or Firm*—Craig and Burns

[57] ABSTRACT

An internal combustion engine has means for stabilizing the position of a yoke and piston during the reciprocating movement. A pressure source transmits a force to one side of yoke to maintain the yoke in constant contact with a bearing surface on the wall of the crankcase, at the same time, the pressure source causes lubrication to be continually transmitted to a sliding block within the yoke at all positions of the crankshaft to lubricate the bearing between the crank throw and sliding block and the bearings between the sliding block and yoke to minimize wear during extended use. The yoke and piston are further stabilized in their reciprocating motion by a peg and ring configuration, one of which is mounted to the crankcase and the other mounted to the yoke. Twist of the yoke and piston about the cylinder axis is prevented by channels in the crankcase wall within which the yoke edges slide.

32 Claims, 24 Drawing Figures

FIG. 20.
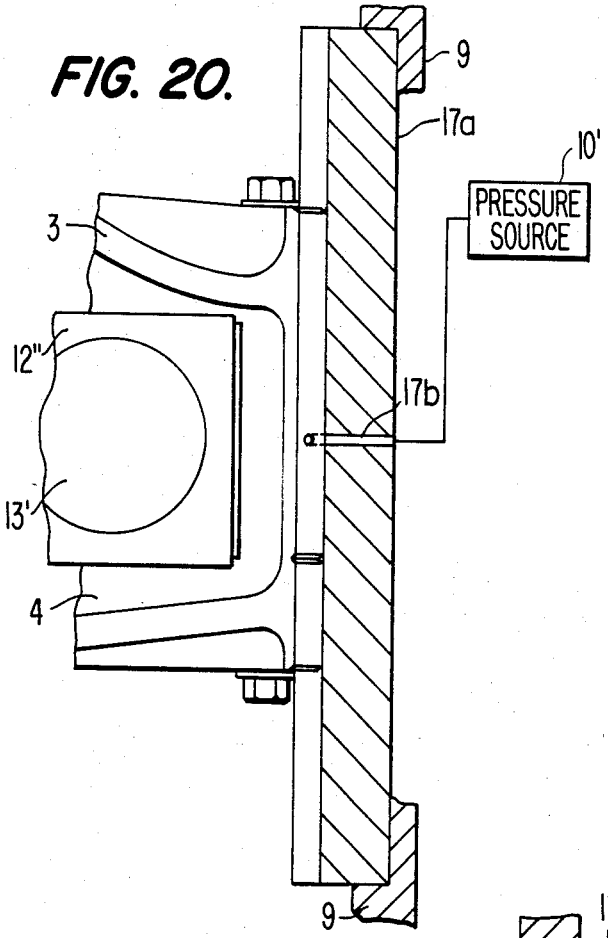
FIG. 21.
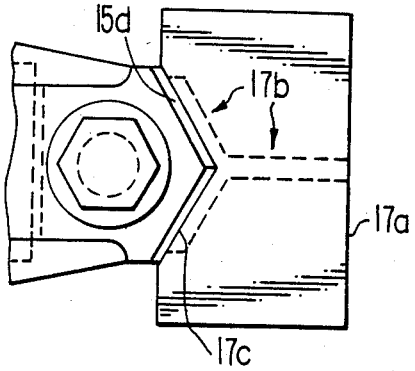
FIG. 22.
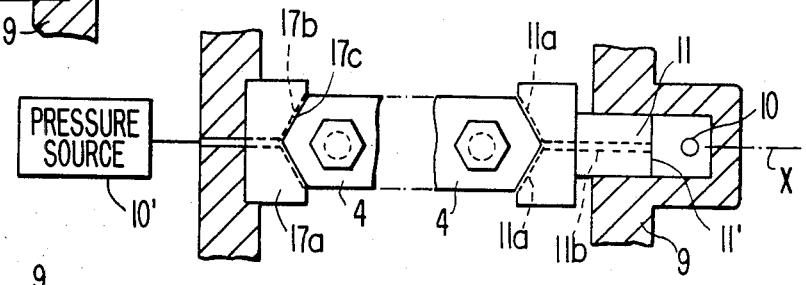
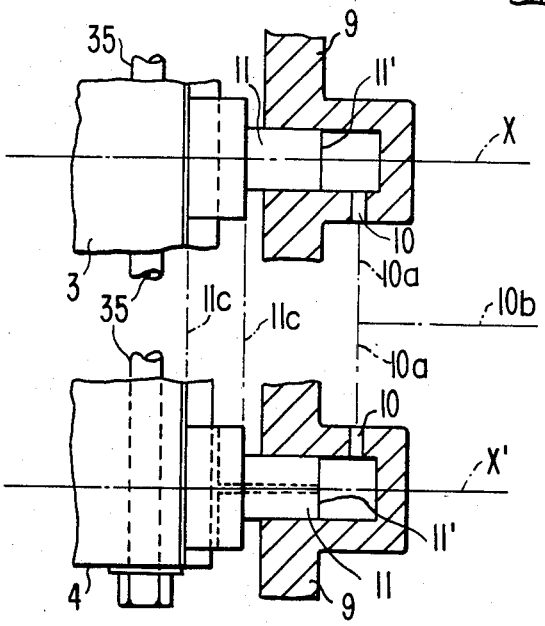
FIG. 23.

APPARATUS FOR STABILIZING THE POSITION OF A YOKE IN AN INTERNAL COMBUSTION ENGINE

This is a continuation-in-part of application Ser. No. 614,475, filed May 29, 1984 now abandoned.

This invention relates to internal combustion engines and, more specifically, to internal combustion engines employing a scotch yoke, at least one of which is disclosed in U.S. Pat. No. 4,013,048 issued Mar. 22, 1977 to Daniel M. Reitz.

In certain of the prior art engines, for example that disclosed by Reitz, pairs of cylinders with each pair coaxially aligned and disposed back to back with the piston rods extending from the pistons reciprocating in each of the pairs of cylinders are coaxially aligned and joined by a yoke. The center of the yoke is transversely slotted to receive the throw of a crank so that, as each pair of pistons and their yoke-joined piston rods reciprocate as a unit, the crank throw will not only reciprocate with and in the direction of the yoke but will also reciprocate transversely in the yoke slot. The crankshaft thus receives a desired rotary driving motion from the reciprocation of the paired pistons.

The relationship of the piston rods, yoke and the throw of the crankshaft in a scotch yoke engine are such that the acceleration of the piston rod departing from top dead center is slower for a given angular displacement of the crankshaft when compared to the comparable action in a conventional internal combustion engine of the kind wherein the piston is connected to the crankshaft throw by means of a wrist pin and connecting rod.

This results in maintaining the fuel air mixture under higher pressure for a longer period of time compared to that for the conventional engine described, thereby facilitating a more complete burning prior to opening of an exhaust port.

At the same time, less cylinder wall is exposed during burning during such movement compared to the comparable action in the described conventional internal combustion engine, resulting in lower thermal losses through the cylinder wall which, in turn, translates to improved overall thermal efficiency with attendant increase in the amount of power available per each unit of fuel and air burned.

Other parameters being equal, a scotch yoke engine may be expected to exhibit a lower exhaust gas temperature compared to the described conventional internal combustion engines.

While the prior art, as exemplified by the Reitz patent, addressed the problem of minimizing the number of parts in an engine, the resulting engines proved difficult to produce and to maintain. The configuration of the members in a scotch yoke engine of the prior art results in excessive wear and resulting destabilization, that is, misalignment of the piston and yoke within the cylinder and crankcase as contrasted to operation of comparable engines of the wrist pin and connecting rod type.

Employed in a two-stroke cycle, the prior art engines required complicated seals while the use of opposing cylinders makes for unconventional space requirements for the engine and attendant complications for maintenance and repair.

Further, the premixing of oil with gas for two-stroke cycle operation results in engine operation with unacceptably high pollution according to existing pollution standards imposed by law. Endeavors to comply with emission standards now in force make the prior art engines of the Reitz type unacceptable to the public.

The patent to Nelson, 2,290,202 issued July 21, 1942 shows a comple structure for stabilizing a yoke.

The U.S. patent to Slemmons, 2,588,666 shows the use of a circular slot for oil distribution in a piston assembly and lubrication of a journal bearing using bearing inserts of complex design in FIG. 11 by slots which only partially cover the surface of the bearing.

Accordingly, it is an object of the invention to produce a scotch yoke internal combustion engine which overcomes the deficiencies in the prior art.

It is a further object of the invention to provide a scotch yoke internal combustion engine for fractional and multi-horse power vehicles, both for land and air travel.

It is another object of the invention to provide a scotch yoke internal combustion engine useful for static power plants of fractional and multi-horse power sizes.

It is another object of the invention to stabilize the position of a yoke and sliding block within a cylinder and crankcase of an internal combustion engine by minimizing wear on the bearing surfaces of the yoke and sliding block therein in the provision of substantially continuous and constant lubrication of oil pressure thereto and by generating a force against the yoke in response to a continuous and constant lubrication pressure to maintain the yoke in continuous engagement with a bearing surface in or on the wall of the crankcase.

It is an object of the invention to produce an internal combustion engine of the scotch yoke type capable of operating on a two-stroke cycle operation.

It is another object of the invention to produce an internal combustion engine of the scotch yoke type operating on a four-stroke operation.

It is another object of the invention to produce an internal combustion engine of the scotch yoke type useful in fuel injection or diesel operation.

It is another object of the invention to provide an internal combustion engine of the scotch yoke type for four-stroke cycle operation wherein problems attendant the sealing of the combustion chamber and crankcase are greatly minimized.

It is another object of the invention to provide an internal combustion engine of the scotch yoke type designed for four-stroke cycle operation with improved lubrication capabilities and operating characteristics.

It is another object of the invention to provide an internal combustion engine of the scotch yoke type designed for reduced wear of engine parts during operation.

It is another object of the invention to provide an internal combustion engine of the scotch yoke type designed for ease in manufacture.

It is another object of the invention to provide an internal combustion engine designed for low cost manufacture.

It is another object of the invention to provide an internal combustion engine of the scotch yoke type designed for ease in retrofitting existing engines of conventional construction to provide them with scotch yoke structure and operation.

It is another object of the invention to provide an internal combustion engine of the scotch yoke type having a multiple number of cylinders.

Another object of the invention is to produce an internal combustion engine having a piston with a yoke mounted to the piston for movement along the axis of the cylinder, a sliding block within the yoke for movement along a second axis substantially orthogonally related to the first axis and means for stabilizing the position of the yoke for movement along the first axis comprised of a bearing means mounted to the crankcase which contacts the yoke.

Another object of the invention is the provision of apparatus for an internal combustion engine having a piston and a yoke mounted to the piston with means for centering the yoke within the crankcase comprised of a peg mounted either to the yoke or the crankcase and a containing means mounted to one of the yoke and crankcase to which the containing means is not mounted, the peg means and the containing means serving to restrain the movement of the yoke in two different directions orthogonal with respect to the first axis.

Another object of the invention is the provision of apparatus for an internal combustion engine having a yoke and a sliding block engaging the yoke and a crank throw mounted within the sliding block with means for maintaining continuous lubrication pressure transmitted from a lubrication port in the crank throw to at least a bearing between the yoke and sliding block.

It is another object of the invention to produce an internal combustion engine of the scotch yoke type wherein the yoke is stabilized for movement along the axis of the cylinder wherein the yoke is under constant pressure to engage at least one surface mounted to or integral with the crankcase, the pressure being maintained throughout extensive periods of wear on the bearing surfaces.

It is another object of the invention to provide an internal combustion engine of the scotch yoke type wherein rotation or twist of the yoke about the axis of the cylinder and relative to the surface of the crankcase is stabilized or substantially prevented during operation over long periods.

It is another object of the invention to provide an internal combustion engine of the scotch yoke type wherein the rotation or twist of the yoke about the axis of the cylinder relative to the surface of the crankcase is stabilized by means of V-ways, one of which is mounted to the crankcase and the second of which is either fixed or movably mounted to the crankcase, the yoke being disposed between the V-ways, a force being exerted by the movable V-way bearing against its corresponding yoke surfaces in response to a pressure exerted against the V-way member from the crankcase wall or in response to a pressure from a pressure source.

These and other objects, features and advantages of the present invention will become more apparent from the following description when taken in connection with the accompanying drawings which show, for the purposes of illustration, plural embodiments in accordance with the present invention and wherein:

FIG. 20 shows a detail of a modification according to the invention employing V-ways for centering the yoke against rotation about the cylinder axis.

FIG. 21 shows a top view of the V-way member together with its engaging portion of the yoke.

FIG. 22 shows another modification of the invention, top view, wherein one of the V-way members is movably mounted with respect to the crankcase, a second V-way member being fixed to the opposite side of the crankcase, a pressure source applying pressure to the movable V-way member.

FIG. 23 shows yet another modification of the invention employing plural V-way members mounted to the same side of the crankcase, a common source applying a pressure to the movable V-way members.

Figure 1:
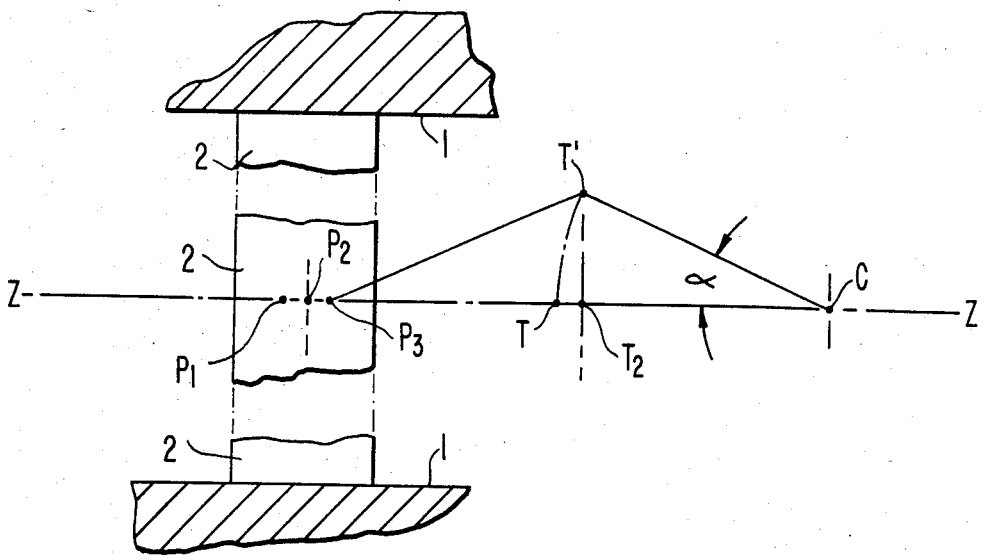
FIG. 1 shows a diagram wherein the movement of a scotch yoke piston with respect to the cylinder is compared to comparable movement of a piston employing connecting rod and wrist pin structure.

Turning now to a consideration of the figures of the drawings wherein like elements are represented by like reference characters, and more specifically to a consideration of FIG. 1, the figure shows a diagram useful in evaluating the characteristics of engines employing a scotch yoke mechanism compared to the connecting rod and wrist pin mechanism.

The crankshaft axis is designated by C and the center of the throw, at top dead center, is designated T. The length of a connecting rod to the wrist pin in a conventional engine is represented by the line $P_1$-T. When the crankshaft rotates by the angle alpha, the throw moves from T along the arc to T'. The connecting rod is moved to a position T'-$P_3$.

In contrast, in a scotch yoke mechanism wherein the throw T is at top dead center, rotation of the throw to T' causes translation of the yoke to a point $T_2$ and the corresponding movement of the piston $P_1$-$P_2$ will be identical in magnitude to the aforesaid translation so that any portion of the piston will also be translated along the axis of the cylinder by the distance T-$T_2$.

From the foregoing, it will be apparent that for identical rotational movement of the crankshaft in the vicinity of top and bottom dead center, the scotch yoke mechanism will move the piston within the cylinder by a smaller distance than that caused by the comparable movement of a conventional connecting rod/wrist pin mechanism.

The effect of the phenomenon in the scotch yoke engine is to cause the fuel/air mixture to be under higher compression for a longer period of time, that is, for a given angle of rotation compared to that effected by the conventional mechanism, resulting in more complete burning of the fuel/air mixture.

Additionally, the distance $P_1$-$P_2$ is a measure of the amount of surface of the cylinder walls exposed by the movement of the yoke through a crank rotation of an angle alpha which is smaller than the distance $P_1$-$P_3$ representing the exposed portion of the cylinder walls created by rotation of a crank from top dead center through an angle alpha in a conventional connecting rod/wrist pin engine.

Accordingly, thermal efficiency is better in the scotch yoke engine, by virtue of lower thermal losses through the cylinder walls for a particular period of time, compared to the conventional engine.

Considering now the invention, it will be appreciated that ignition, carburetion, fuel injection or the like, lubrication other than that to be described below, and other operations ancillary to engine operation will be performed in accordance with practice known to those skilled in the art. The description which follows is limited to those features involved in the invention for the sake of simplicity.

Figure 2:
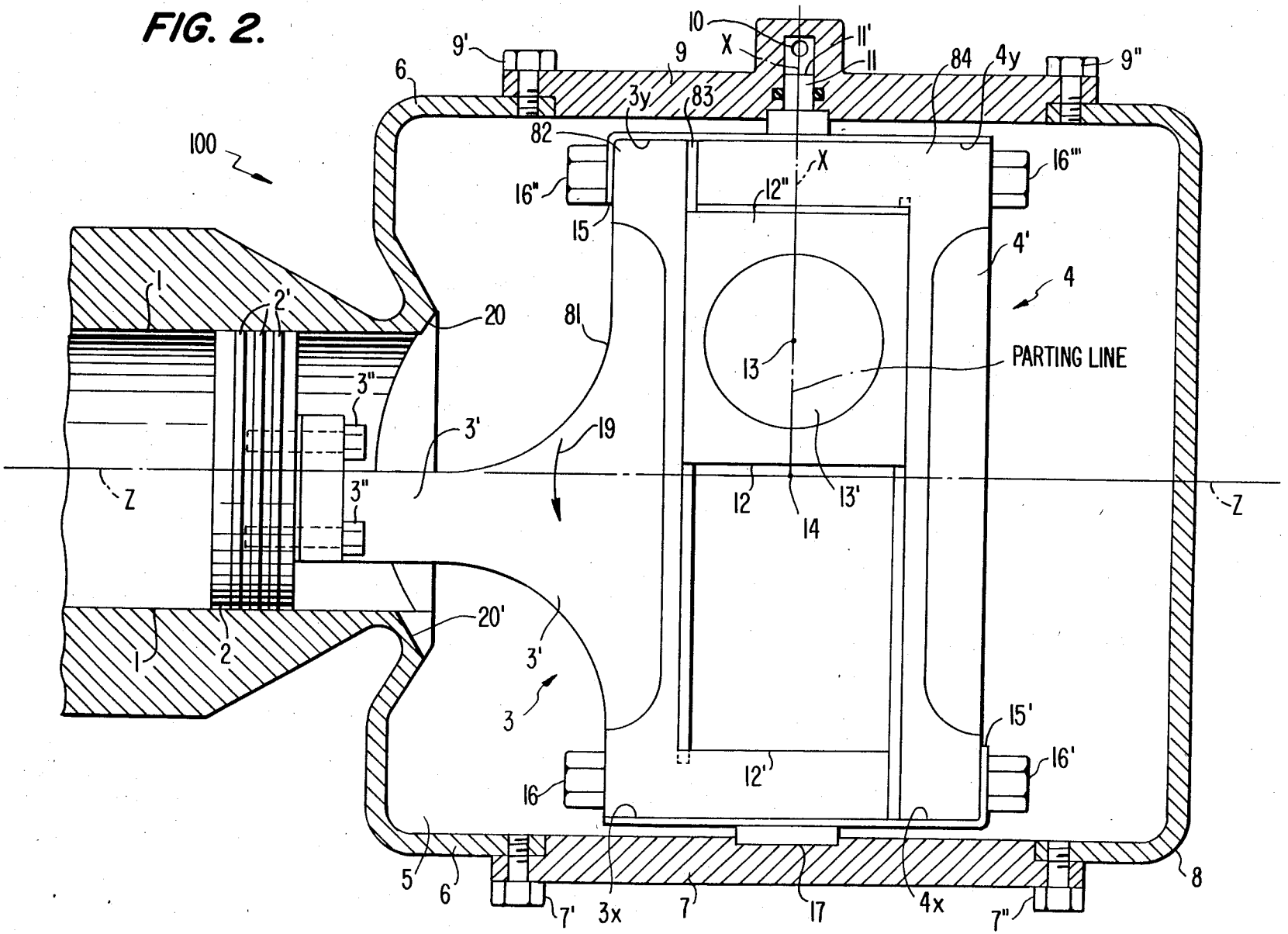
FIG. 2 shows an embodiment of the invention for a single cylinder of an engine.

FIG. 2 shows an embodiment of the invention for a single cylinder of an engine generally designated by the reference numeral 100. The cylinder walls 1 contain the piston 2, with piston rings 2', to which is mounted the upper member 3, 3' of a yoke 3, 3', 4, by bolts 3''.

It will be appreciated by those skilled in the art that the member 3 may be mounted to the piston by any means, for example, by welding, brazing or the like. Alternatively, the piston 2 and the upper part of the yoke 3, 3' may be cast as a single piece. The yoke is completed by a lower member 4 mounted to the upper member 3, 3', by nut and bolt or other fastening assemblies 16, 16', 16'' and 16'''.

The crankcase 5 has a housing comprised of members 6, 7, 8 and 9. The respective members may be joined by any means conventional in the art and the bolts 7', 7'', 9' and 9'' indicate only an exemplary fastening means.

One or more of the members 6, 7, 8 and 9 may be joined together or may be integral, without departing from the invention, depending upon the particular considerations requisite for a particular engine.

The configuration shown is felicitous for assembly during manufacture or retrofitting and provides for ease in dismantling and assembly during maintenance and repair.

The reference numeral 14 designates the center of rotation of the crankshaft while 13 designates the center of the crank throw 13' shown in the figure as halfway between top and bottom dead centers.

The motion effected by the yoke 3, 3', 4 is translated to the crank throw 13' by means of sliding block 12 which is mounted to engage the upper and lower surfaces of yoke members 3, 4. During the linear movement of piston 2 and yoke members 3 and 4, from top dead center to bottom dead center and back, the crank throw 13' which is received by the sliding block 12, will describe a rotational motion about the center 14 by means of the reciprocating sliding block 12 in its excursions along a second axis substantially orthogonal to cylinder axis z—z from one extreme lateral location 12' to the second extreme lateral location 12'' with respect to the cylinder axis z—z.

Those skilled in the art will recognize that alternate equivalent structures may be employed in lieu of the slot in the yoke 3, 4 within which the sliding block 12 slides, without departing from the invention.

Stability of the yoke 3, 4, within the crankcase along axis z—z, FIG. 2, is effected by bearing members 15 and 15' positioned in planes which intersect the second axis substantially orthogonally, and which planes are parallel to the first axis z—z. The bearing members 15 and 15' are respectively mounted to the yoke members 3 and 4 by bolts 16 with attendant nuts 16'. While advantageously, bearing members such as 15 and 15' may be used, it will be appreciated that the edge surfaces 3*x*, 3*y*, 4*x* and 4*y* of the yoke members 3 and 4 respectively may be employed as bearing surfaces to engage plate 17 or a machined surface of the crankcase surface 7, and bearing shoe 11.

Bearing member 15' engages a bearing plate 17 mounted to the crankcase housing member 7 as shown in FIG. 2. One or more such bearing plates may be provided disposed along the wall 7. Bearing member 15 engages a bearing shoe 11 received in crankcase housing member 9, movable along the axis x—x. Similarly, plural bearing shoes 11 may be provided disposed along the wall 9.

A port 10 which is connected to pressure system of the engine, imparts pressure to the face 11' whereby bearing shoe 11 exerts pressure against bearing member 15, the effect being to cause the yoke members 3 and 4 to exert pressure by way of bearing member 15' against the plate 17 mounted to the opposite slide of the crankcase at 7. The result of the described effect, therefore, of the bearing arrangement according to the invention, is to stabilize the position of the yoke 3 and 4 within the crankcase housing along the axis z—z between the plate 17 and the bearing shoe 11.

While the invention has been described as employing oil pressure generated by a pressure source which may be an oil pump of the engine, it will be appreciated that any pressure source may be employed, pneumatic, electromagnetic, or the like imparted to the surface 11' of the bearing shoe 11, so long as such a pressure is effective to apply force to the yoke by way of member 15 to cause the yoke to bear against the plate 17, or, alternatively, a surface on the wall of the crankcase at 7 opposite the bearing shoe 11.

While continuous pressure by bearing shoe 11 may be effected in an alternative embodiment by means of a spring disposed between the crankcase member 9 and the bearing shoe 11, such a configuration is subject to fatigue of the spring over long periods of operation. The invention therefore contemplates in one embodiment, as shown, application of lubricant or oil pressure applied to the bearing shoe, thereby avoiding the problem of fatigue presented by the alternative spring structure. Moreover, it will be appreciated that by use of application of continuous pressure applied to bearing shoe 11, stabilization of the yoke 3 will be effected regardless of the wear on members 15, 15', the face of 11 which engages 15, and the bearing plate face which engages member 15'. Thus, though wear may occur through long use, play between yoke and crankcase wall at 17 is either greatly reduced or virtually eliminated.

The configuration of the invention, as described, thus materially extends the operational life of the engine making disassembly for maintenance significantly less frequent than has heretofore been experienced in the operation of scotch yoke engines. An attendant reduction in maintenance costs is also experienced.

The disposition of the bearing members 15 and 15' is such that during the movement of the yoke 3, 4 from top dead center to bottom dead center, maximum pressure is effected by the bearing plate 15' against the plate 17 compared to pressure during the return stroke, the crankshaft rotation being in the direction indicated by the arrow 19. Inasmuch as the bearing member 15' is mounted at the leading edge of the yoke 4 by nut and bolt 16, 16', the bearing member 15', during maximum pressure, is under tension, for the particular direction of rotation of the crankshaft shown by arrow 19.

By the same token, on the return stroke maximum pressure is experienced by bearing member 15 which is mounted to the yoke member 3 by the bolt 16'', the bearing member 15 being under tension during the return stroke to top dead center. Thus, the bearing members 15 and 15' being under tension during their periods of maximum pressure do not experience a tendency to buckle.

If the direction of rotation were reversed, the mounting of the bearing members 15 and 15' may be reversed to maintain the same condition of tension during maximum bearing pressure.

In an alternate embodiment, bearing members 15 and 15' may be dispensed with, the sides of the yoke members 3 and 4 serving as bearing surfaces, engaging bearing shoe 11 and plate 17.

In still another modification, bearing plate 17 may be dispensed with, the yoke member bearing directly on the side of the crankcase. Experience has shown that machining crankcase surfaces to a satisfactory precision requires close tolerances over a significantly large surface so that advantageously, a bearing plate with relatively limited machined surface made of an appropriate material, an example of which will be described later, has been found to be entirely satisfactory.

Figure 18:
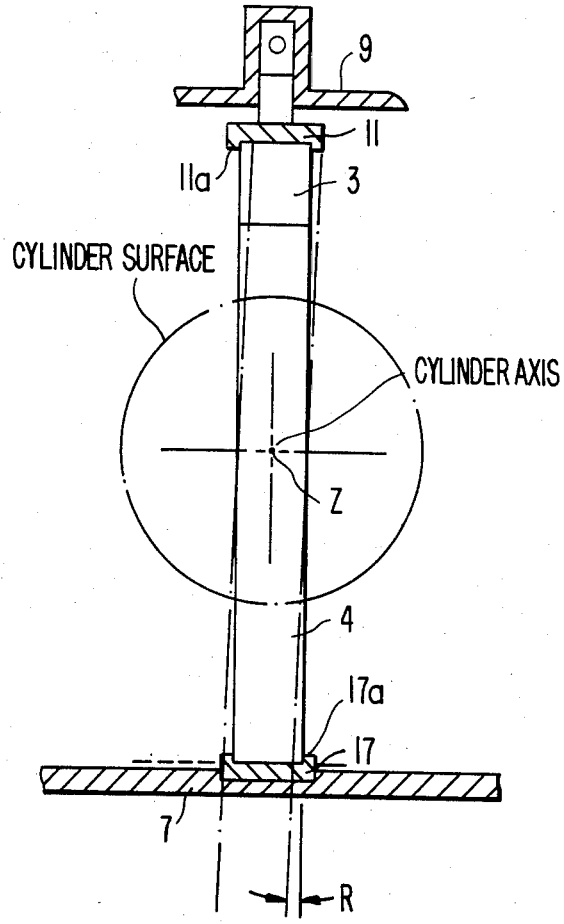
FIG. 18 shows an end view from the cylinder axis of the yoke and another embodiment of the invention for stabilizing the position of the yoke.
Figure 19:
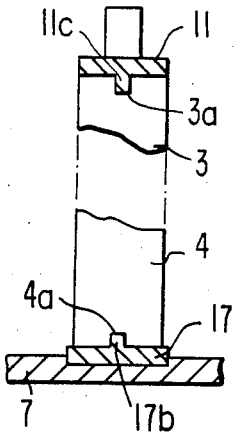
FIG. 19 shows an alternate configuration for the features of FIG. 18.

As shown in FIG. 18, stabilization of the yoke 3 and 4 against rotation or twist around the cylinder axis z may be effected by providing one or both of ridges 11*a* in the bearing shoe 11 and ridges 17*a* in the bearing plate 17 which result in recessed channels in the faces of bearing shoe 11 and bearing plate 17. The sides of the ridges 11*a* and/or 17*a* engage the sides of the yoke 3 and 4, whereby rotation of the yoke about axis z, for example as shown by the angle R, is prevented. FIG. 19 shows an alternative construction wherein the yoke 3 and 4 has a channel 4*a* to receive a ridge 17*b* in the bearing plate 17. A comparable configuration can be effected with regard to the bearing shoe 11 wherein a slot 3*a* in the yoke 3 may receive a ridge 11*c* which extends from the surface of the bearing shoe 11.

Yokes have been employed with architecture such as that shown in French Pat. No. 640,934 (Class 74, subclass 50). This architecture employing curved surfaces is difficult and expensive to manufacture and invites uneven and asymmetric wear during operation.

FIG. 20 shows another modification according to the invention wherein the yoke 3, 4 is disposed between two V-way members, 17*a*, only one of which is shown in the figure. Lubrication to the V-way 17*a* is provided by oil channel 17*b* which is connected to a pressure source 10'. V-ways 17*a* are mounted to the crankcase walls 7 (as shown in FIG. 20) and 9.

FIG. 21 shows a top view of an exemplary V-way member 17*a* which engages at the face 17*c* a corresponding surface of the yoke 3, 4. The yoke 3, 4 may be provided with bearing members such as 15*d* which engage the surfaces of the V-way member 17*a*. The bearing surfaces 15*d* may be composed of materials as will be hereinafter described.

FIG. 22 shows yet another modification of the invention wherein one of the V-way members 17*a* is mounted to the crankcase 7 while the opposing V-way member 11, a movable member, is disposed in the opposite side of the crankcase 9, the movable member 11 having a V-way mounted to one end at 11*a* to engage the opposing side of the yoke. A pressure source will provide pressure by way of the aperture 10 which will be exerted against the surface 11' to force the member 11 against the surface of the yoke 3, 4.

FIG. 23 shows another modification according to the invention wherein plural members 11, both positioned on the same side of the crankcase 9 engage, by means of their respective V-ways at 11*a* a surface of the yoke to fix the position of the yoke with respect to the crankcase and with respect the cylinder axis z.

Consonant with the showing in FIG. 21, pressure source 10 may apply lubrication by channels 17*b* of the fixed V-way member 17*a*, as shown in FIG. 22.

By the same token, movable V-way member 11, as shown in FIG. 22, may have a channel 11*b* serving to lubricate the face of the V-way member. The size of the channel 11*b* is suitably proportioned with respect to the surface 11' so that the pressure at the face of the yoke 3, 4 is sufficient only for the purposes of providing lubrication but does not significantly detract from the pressure exerted at the fact 11' of member 11, the latter pressure serving to firmly fix the position of the yoke 3, 4 during its reciprocation period. Put another way, the pressure loss in the channel 11*b* due to its small cross section compared to the cross section of the surface 11' will be such that the dominant force will be that applied at the face 11' to ensure the engagement of the member 11 to firmly fix the position of the yoke 3, 4.

In the FIG. 23, the members 11 are shown as separately movable but engaging the surface of the yoke under a pressure derived from a common source by lines 10*a* and 10*b*. In another embodiment of the invention, a single member 11 may be supported movably with respect to the crankcase at 9 at a number of spaced points along the axes x and x' (two are shown as exemplary), the member being schematically indicated by the construction lines 11*c* in FIG. 23. In this modification of the invention, the pressure arriving from source 10' along the line 10*b* divides at 10*a* to enter the pressure chambers adjacent the surfaces 11' and serving to move the member 11 toward the yoke along the plural or multiple axes such as x and x'.

From a consideration of FIGS. 20–23, it will be apparent that by means of the invention as disclosed, the position of the yoke is maintained aligned with the axis of the cylinder at the same time actively prevented from twisting or rotation about the axis of the cylinder. The structure of the invention, as shown in these figures, is relatively simple to manufacture, with concomitant decrease in expense, at the same time providing constant and precise positioning of the yoke.

Specifically, with regard to the use of V-guides to stabilize the lower end of the scotch yoke, utilizing these feed guides as shown in the drawings, it is possible to have full stabilization of the yoke in such a manner that the piston itself need never touch the cylinder wall or may be just a tiny clearance of a thousandths of an inch would still allow for this lack of physical contact to occur with the piston never touching the cylinder wall side thrust on the piston a major source of internal friction is eliminated. For that matter it has been accepted as a rule of thumb over the years that the pistons sliding in the cylinder for any given internal combustion engine account for fifty percent of the internal engine friction with a V-guided yoke in the engine working in conjunction with the Holtz gas lubricating piston rings it is possible to achieve a situation wherein virtually nothing physically contacts the cylinder wall of the engine during operation. This would substantially eliminate fifty percent of the internal engine friction, the V-guides providing some minor friction in the lower end of the yoke but since these V-guides in the lower end of the yoke are composed of special bearing materials, such as those described herein, the friction that would be contributed from instituting that form of stabilization would be minimal compared to the friction that had been reduced by not having the piston physically contact the cylinder wall. This particular feature is especially important when one considers the application of ceramic cylinder wall coatings for the use in adiabatic diesel and gasoline engines. With ceramic coatings the main problem experienced in the past is friction as a result of side thrust on the piston. With this arrangement this problem has been eliminated and presently available ceramic coatings can be used in an adiabatic engine without having to resort to, as yet, special coatings to reduce the friction. Concerning the V-guides, not only will they be made of bearing material but they will be in the portion of the crankcase where they will lubricated sufficiently either by splash lubrication in the case of low speed operations or by pressurized oil lubrication to the bearing surface as is standard practice in almost any other situation.

From the foregoing it will be apparent that the practice of the invention serves to materially increase the efficiency of the engine by reduction of friction and reduces wear by the stabilizing of the yoke within the crankcase.

An inspection of FIG. 2 shows that the casting of the cylinder block which contains the cylinder walls 1 and the upper portions of the crankcase housing 6 has been recessed at 20 and 20' to allow passage of the crankshaft and throw 13', admitting the appropriate clearances, at the same time making it possible to design the piston 2 and yoke assembly 3, 3' and 4 as a compact unit. By shortening the distance between the piston 2 and the axis 14 of the crankshaft, the mass and weight represented by the piston 2 and the yoke 3, 3' and 4 are reduced.

Inasmuch as the yoke 3, 3', 4 and piston 2 are stabilized as to position for example, by the walls 1 of the cylinder and by means of the plate 17 and bearing shoe 11 in the embodiment shown, the need for reliance upon a piston skirt as a stabilizing mechanism for the piston is substantially reduced so that the piston itself requires little or no skirt, making it possible to effect a further reduction in piston weight and in the distance between the yoke 3, 3' and 4 and the piston 2. The invention thus makes it possible to configure a piston and yoke whose axial dimension along the cylinder axis is minimal, allowing only for piston rings 2' to seal against the cylinder wall 1, the neck 3' of the yoke member 3 being shortened so that the piston 2 barely clears the surface of revolution described by the crankshaft and crank throw 13.

Yoke members 3 and 4 may be recessed as shown at 3' and 4', respectively, for the purposes of reducing weight and for economizing on material.

Figure 3A:
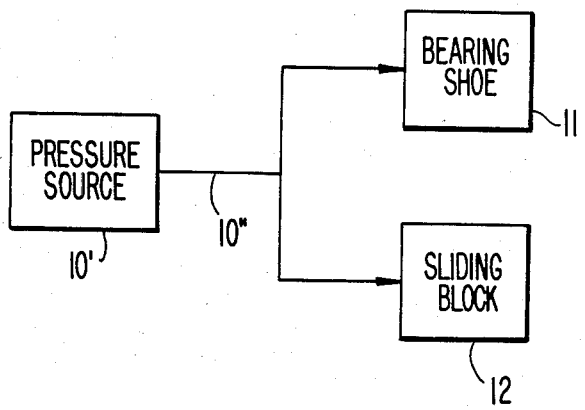
FIG. 3A shows the control configuration for stabilizing the position of the yoke in accordance with the teachings of FIGS. 2 and 3.
Figure 3:
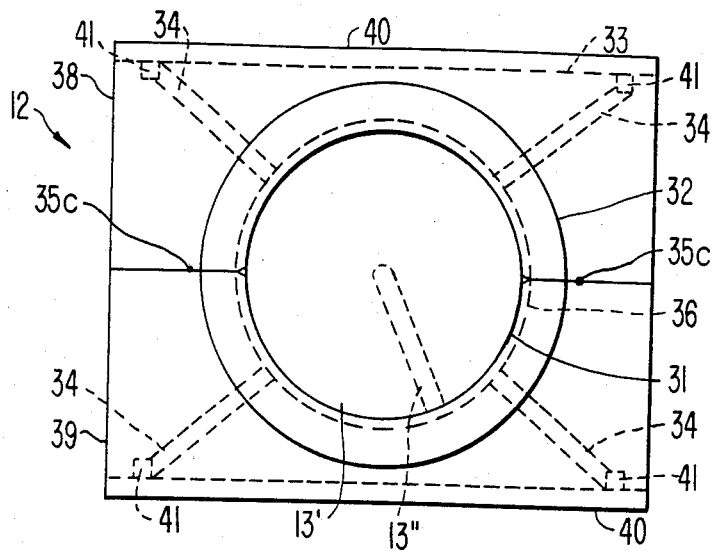
FIG. 3 shows a side view of a sliding block with crank throw in accordance with the present invention.

FIG. 3 shows the sliding block generally designated by the reference 12 composed of two half blocks 38 and 39. As shown, for example, in FIG. 3, the halves 38 and 39 of the sliding block 12 are retained in position relative to each other by the crank throw 13' and the upper and lower members 3 and 4 respectively, of the yoke 3, 3', 4.

A shoulder 32 retains and centers sliding block 12 and yoke members 3 and 4 with respect to the crankshaft and crank throw 13'. The outer surface of the crank throw 13' engages, in journal bearing manner, the cylindrical surface 31 provided by the members 38 and 39. A circular recess 36 is introduced to the cylindrical surface 31, which recess 36 is located to register with a lubrication port 13'' exiting the crank throw 13' of FIG. 2. The top and bottom of the half blocks 38 and 39 have surfaces recessed at 33, the surface of 33 serving as a sliding bearing engaging corresponding surfaces of yoke members 3 and 4.

Ridges 40 retain the half blocks 38 and 39 in registration with the surfaces of the yoke members 3 and 4, which ridges 40 ride on the sides of the yoke members 3 and 4. Ridges 40, in retaining the half blocks 38 and 39 serve also to prevent twist of the yoke about the cylinder axis z—z, best shown in FIG. 2. As a result of the ridges 40, the stabilization of the yoke 3, 4 in its movement along the cylinder axis z—z, and in its engagement with bearing plate 17 and bearing shoe 11 is improved, notwithstanding the fact that, in extended operation, parts of the engine may wear which would tend to destabilize the yoke 3 during its movement along the axis z—z.

From the periphery of cylindrical surface 31, lubrication holes 34 radiate to communicate with the recessed surfaces 33 by way of cross channels 41 so that lubricant emitted by the lubrication port 13'' in the crank throw 13', FIG. 2, and dispersed across the cylindrical surface 31 as a journal bearing, will in addition find egress by way of the channel 36 and lubricant holes 34 to reach the surfaces 33 at channels 41, thence across the full width of the surfaces 33 by means of cross channels 41, to lubricate the interior sides of the ridges 40 and the engaging surfaces of the sides of yoke members 3 and 4 by means of recesses 42 in the ridges 40.

In accordance with the invention, the recess 36 provides that, as the crank throw 13' rotates, no matter where the oil port 13'' from the crank throw 13' is positioned with respect to the cylindrical surface 31, lubricant from the crank throw port 13'' will exit the throw into the recess 36 continually, providing lubrication under substantially constant pressure.

This is in contrast to the lubrication of intermittent pressure disclosed in the prior art wherein the rotation of the crank throw with respect to the sliding block causes blocking of transmission of lubrication from the crank throw lubrication port during most of the rotation, affording direct registration of sliding block lubrication channels with the crank throw oil port only for brief instants.

Figure 4:
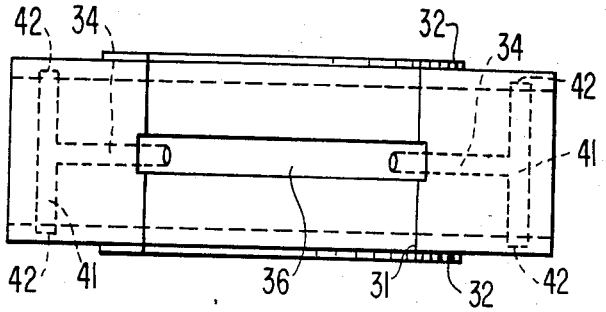
FIG. 4 shows a view of one half of a sliding block in accordance with the present invention exposing the interior of the bearing surface engaging the crank throw.

FIG. 4 shows one half of a sliding block, such as 38 and 39 as shown in FIG. 3, wherein the recess 36 is exposed showing the lubrication holes 34 which radiate from the recess 36 to join the cross channels 41 in the surface 33.

Figure 5:
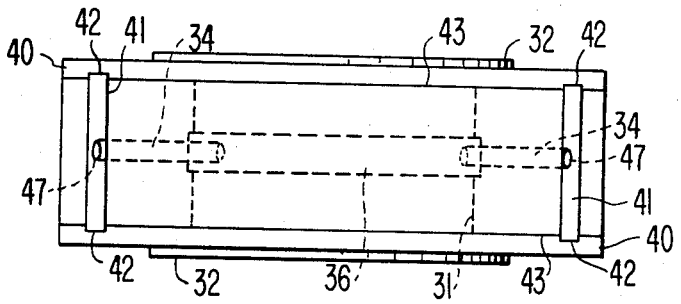
FIG. 5 shows a top view of a sliding block, the figure being representative also of a bottom view.

FIG. 5 shows a top view of a half block such as 38 or 39, the cross channels 41 being exposed with the exit 47 of the lubricant holes 34 visible.

Recesses 42 in the ridges 40 communicate with the cross channels 41 and with the sides of the yoke so that lubrication exiting 47 will travel along the cross channels 41, and recesses 42, along the sides of the ridges 40 to provide lubricant between the sides of the ridges 40 and the sides of yoke members, 3 or 4.

Figure 6:
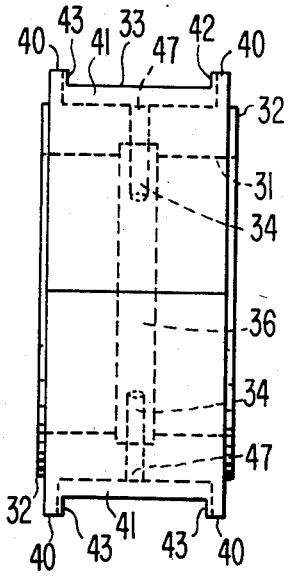
FIG. 6 shows an end view of a sliding block.

FIG. 6 shows an end view of the two sliding block halves 38 and 39 wherein the relationship between the surface 33 and the ridges 40 is more clearly disclosed. Shown in dotted lines is the recess 36, the oil holes 34 cross communicating from the recess 36 to the cross channels 41 and thence to the recessed channels 42 in the ridges.

Figure 7:
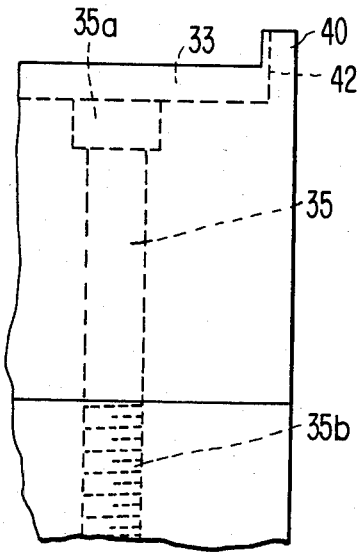
FIG. 7 shows an enlarged partial view of an alternate embodiment of the sliding block of the invention.

FIG. 7 shows an enlarged detail of another embodiment of the invention wherein the sliding block halves 38 and 39 are shown bolted together. One block half is provided with a recess 35 for passage of the bolt together with a recess **35*a* for a bolt head let into the surface 33 so that the bolt head may be below the surface 33 and thereby avoid contact with the passage of the yoke member which engages surface 33. In the other sliding block half, a corresponding hole is provided, tapped to admit the connecting bolt inserted at 35. Two such bolts are provided, one on each side of the crank throw at points, for example, such as 35*c* as shown in FIG. 3**.

The positioning of the bolt holes 35 may be such as to avoid intersection with the lubricant holes 34 as shown in FIG. 3, for example, by positioning the oil holes, such as 34, to bypass the bolt holes, or vice versa.

Figure 8:
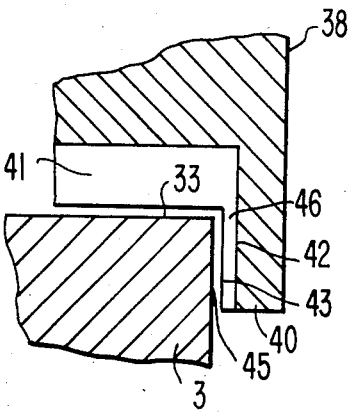
FIG. 8 shows a detail of the relationship of the yoke and the sliding block.

FIG. 8 shows a detail of the yoke 3, in section through the cross channel 41, engaging one sliding block half 38 at the surface 33. The distance between 33 and 38 is shown much enlarged for clarity. The cross channel 41 which receives the lubricant from hole 34 communicates, at 46, with recessed channel 42 in the side of the ridge 40 thereby providing lubricant to the clearance space, shown much enlarged for clarity, between the ridge 40 and the side 45 of the yoke 3 which FIG. 8 shows details for yoke member 3, it will be appreciated that a comparable configuration will obtain for yoke member 4.

It will be seen therefore that, according to the invention all bearing surfaces of crank throw 13', sliding block 12 and yoke 3, 4, are provided with continuous lubricant pressure assuring maximum expectancy of long life with minimum wear.

Figure 9:
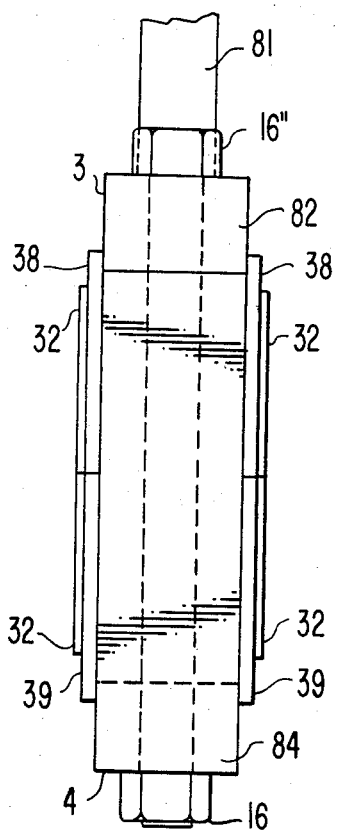
FIG. 9 shows an end view of the yoke, as assembled, with portions of the sliding block visible.

FIG. 9 shows the yoke assembly with upper member 3 and lower member 4 bolted together by a bolt 16 with accompanying nut 16' joining the members 82 and 84. The curved portion, as shown in FIG. 2, of the upper yoke member 3 at 3' joining the piston is shown at 81. The sliding block 12, with its block halves 38 and 39 with shoulders 32 is visible.

Figure 10:
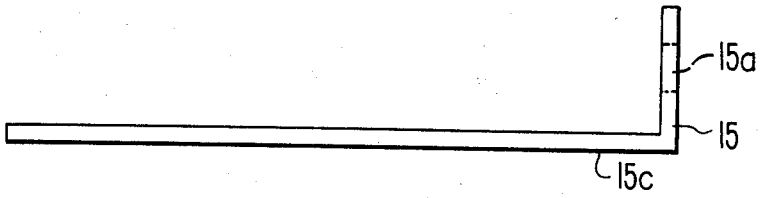
FIGS. 10 and 11 show, respectively, side view and end views of a bearing member of the type which may be assembled to the yoke.
Figure 11:
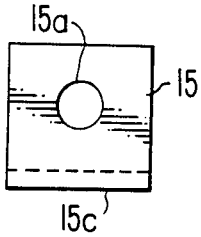

FIGS. 10 and 11 show, respectively, side and end views of a bearing member, such as 15, which, as shown in FIG. 2, may be anchored to the yoke by means of bolts such as 16 or 16'' through a hole **15*a*. The bearing surface 15*c* of the bearing member 15 engages the bearing shoe 11, as shown in FIG. 2. The bearing member 15', as shown in FIG. 2, which engages the bearing plate 17 may have a configuration similar to that shown in FIGS. 10 and 11**.

Figure 12:
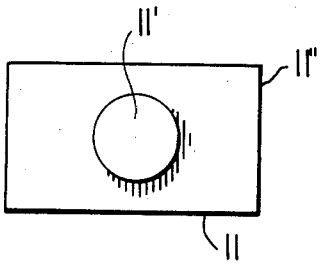
FIGS. 12 and 13 show, respectively, top and side views of a bearing shoe in accordance with the invention.
Figure 13:
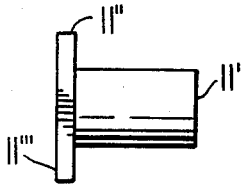

FIGS. 12 and 13 show, respectively, a top and side view of the bearing shoe 11 of FIG. 2. A pressure, for example, lubricant pressure from the lubricant line of the engine is applied at the surface 11', thereby transmitting pressure of the shoe 11'' of the bearing shoe 11 to engage the bearing member 15 at the surface 11'''.

By the invention as described, it is possible, to stabilize the movement of the yoke along the axis z—z, as shown in FIG. 2, by means of containment of the yoke 3 and 4, together with its bearing members 15 and 15' between the bearing plate 17 and the bearing shoe 11.

From the foregoing, it will be apparent that the invention contemplates employment of a pressure to facilitate the operation of the yoke 3, 4 in its movement along the axis z—z in FIG. 2, both to stabilize the yoke throughout a single stroke from continuous pressure by means of the bearing shoe, and to stabilize the yoke throughout extended operation over a long period of time by subjecting the bearing surfaces of the yoke 3, 4 and sliding block 12 to continuous lubrication of substantially constant pressure. FIG. 3A depicts this, wherein a pressure source 10', which can in the exemplary case shown be an oil pump, provides constant pressure along the line 10'', transmitting lubricant by way of the port 13'', FIG. 3, continuously lubricating guiding block 12 to lubricate the surfaces of the crank throw, sliding block 12 and yoke 3, 4 with consequent reduction in wear of the parts involved, resulting in stabilization of the yoke 3, 4 within the cylinder and crankcase 6, 7, 8, 9, at the same time, the same oil pressure through its application to the bearing shoe 11 stabilizes the position of the yoke during movement along the axis z—z, FIG. 2, maintaining the yoke 3, 4 in a constant relation to the side of the crankcase 6, 7, 8, 9 by means of bearing shoe 11.

It will be appreciated that when a pressure source other than an oil pump or lubricating pump is employed to provide pressure to the surface 11' of bearing shoe 11, such a source can be under the control of the oil pump such as 10'. Alternatively, the alternative pressure source can serve to actuate the oil or lubricating pump which provides lubrication to the sliding block channels 36, 34, 41 and 42 of FIGS. 3–8. Stabilization of the yoke 3 and 4 and the sliding block 12 with respect to the crank throw 13'. At the same time pressure is exerted from pressure source 10' to bearing shoe 11 by way of the surface 11' (FIG. 2) to stabilize the yoke against the crankcase wall 7 and bearing plate 17 where an oil or lubrication pump serves as pressure source 10', the control line 10'' is of course an oil or lubrication line. In an alternative embodiment disclosed above where a pressure other than an oil or lubrication pump is employed for the bearing shoe 11, it will be appreciated that the pressure source 10' may serve to apply pressure to the bearing shoe 11 at the same time serving to control an oil pump which supplies oil or lubrication to the sliding block 12.

Figure 14:
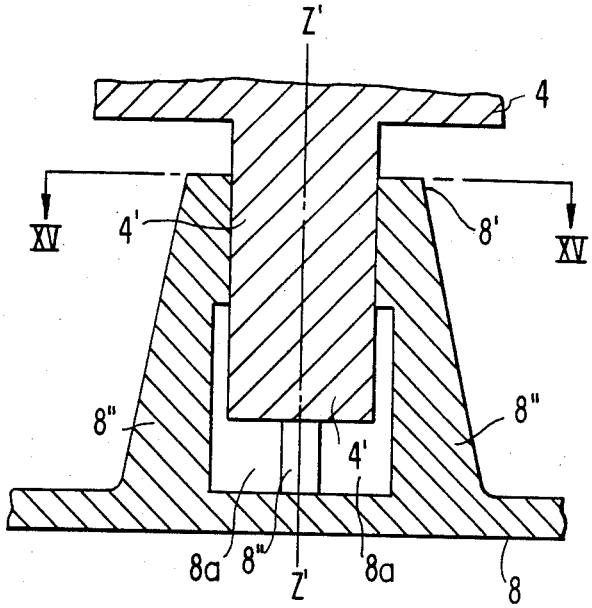
FIG. 14 shows another embodiment in accordance with the invention employing a peg and containing member or ring configuration for the yoke and crankcase housing.
Figure 15:
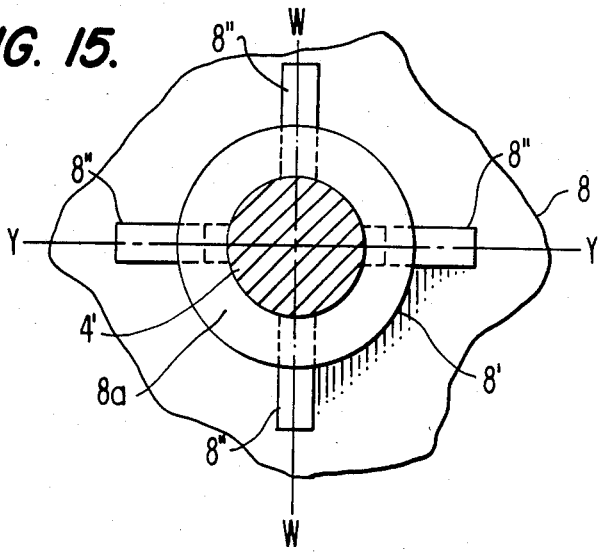
FIG. 15 shows a cross section of the peg and the containing member or ring configuration shown in FIG. 14.

In another embodiment of the invention such containment of the yoke 3, 4 may be effected as shown in FIGS. 14 and 15, wherein yoke member 4, as shown in FIG. 2, may be provided with a peg 4', shown in cross section in FIG. 14 which engages a containing member 8', as shown of ring configuration, either mounted to or integral with crankcase member 8 by support members 8'' elevated sufficiently above the crankcase bottom so that the peg 4 and containing member 8' are always engaged throughout the movement cycle of the yoke member 4. Alternatively, the containing member 8' may be mounted to the yoke and the peg 41 mounted to the crankcase. As yoke 3, 4 reciprocates in response to piston 2, its position is contained at all times by peg 4' riding within containing member 8'.

The apertures 8a disposed between support members 8'' allow lubricant in the crankcase to flow back and forth in the volume swept by the end of the peg 4' as it moves with the yoke 3, 3' and 4.

As shown in FIGS. 14 and 15, the peg 4' and containing member 8' are circular in configuration and are centered around an axis z'—z' which, may be but need not necessarily be, coextensive with axis z—z shown in FIG. 2. It will be appreciated by those skilled in the art that, if desired, the axis z'—z' may be off center with respect to axis z—z shown in FIG. 2.

It will also be appreciated by those skilled in the art that although the peg 4' and containing member 8' are shown in exemplary form in FIGS. 14 and 15 as being circular in cross section, any other cross sectional configuration, square, hexagonal or irregular configuration, or the like, may be employed, and, by the same token it is not necessary that the cross section configuration of peg and containing member be identical or that they engage each other throughout their entire peripheries, it being necessary only to confine the motion of the yoke 3 and 4 by limiting two degrees of freedom, shown in exemplary form in FIG. 15 as the axes w—w and y—y, the yoke being thus limited to freedom of movement only along the axis of the bore of the cylinder z—z of FIG. 2, e.g., z'—z'.

Figure 16:
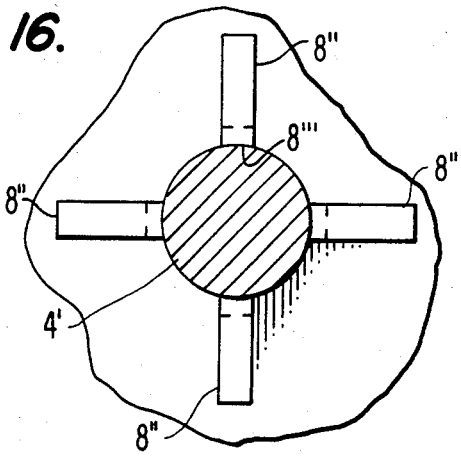
FIG. 16 shows another embodiment of a containing member with peg.

While we have shown member 8' as a ring, those skilled in the art will recognize that the member may take many forms without departing from the spirit of the invention, for example, that shown in FIG. 16 wherein a plurality of posts 8'' extending from the crankcase 8 and presenting surfaces such as 8''' which engage the peg 4' to limit its movement lateral to the axis z'—z'. The peg 4', contained in this manner, has only one degree of freedom in its movement, that along the axis z'—z'. Thus, it will be apparent that the means containing the movement of the peg 4' may take any configuration, ring, post, or the like, so long as the freedom of movement of the peg 4' in any other direction than along the axis z'—z' is substantially prevented.

Figure 17:
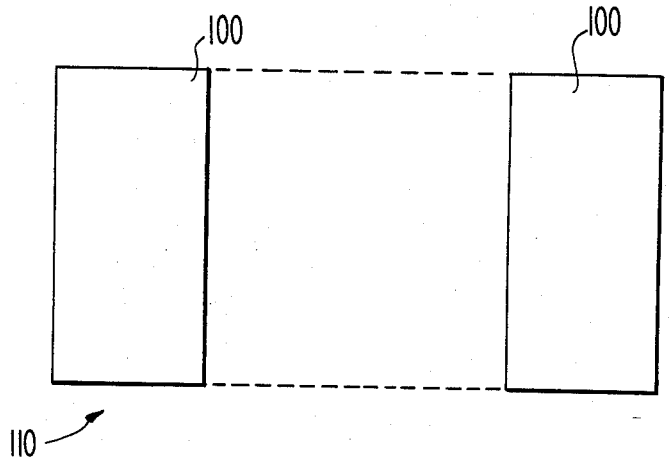
FIG. 17 shows an embodiment of the invention comprised of a multi-cylinder engine.

FIG. 17 is a schematic diagram of cylinder assemblies 100 juxtaposed to each other to form a multi-cylinder engine shown generally by the reference numeral 110. Such a multi-cylinder configuration may assume the "in-line" configuration or, alternatively, may assume the V-type configuration conventional to some automotive engines and the like. Alternatively, it will be appreciated by those skilled in the art that the cylinders may assume any position around the axis of the crankshaft 12, as shown in FIG. 2, accommodation being made for carburetion and ignition timing effected in accordance with practice well known to those skilled in the art.

Concerning the elements which bear upon one another described with regard to the foregoing description for FIGS. 2–15, where two members bear, one upon each other, according to the invention, it is expedient to employ for one or both of the engaging elements, an alloy known as "BEARIUM" ®, a product of Bearium Metals Corporation, 1170 Chili Ave., Rochester, N.Y. 14624. This substance, when employed, either as a bearing shoe 11, bearing members 15 and 15', bearing plate 17 sliding block 12, peg 41 or ring 81, serves as a most effective bearing, both for withstanding excessive loads and for extending bearing life and hence the life of the engine.

BEARIUM ® metal is manufactured in a variety of alloys:

| Alloy | % Cu | % Pb | % Sn | % Ni |
|---|---|---|---|---|
| B4 | 70 | 26 | 4 | 0 |
| B8 | 70 | 22 | 8 | 0 |
| B10 | 70 | 20 | 10 | 0 |
| B11 | 70 | 20* | 9* | 1* |

*approximate

Alloy B10 has been found to be excellent for use as a sliding block, bearing plate and bearing shoe.

BEARIUM ® metal has the following characteristics:

MECHANICAL PROPERTIES OF BEARIUM T METALS

| | GRADES | | | |
|---|---|---|---|---|
| | B-4 | B-8 | B-10 | B-11 |
| Yield Strength #/in$^2$ (.2% Perm. Set) | 11,000 | 14,000 | 14,750 | 16,000 |
| Tensile Strength #/in$^2$ | 21,500 | 24,000 | 25,500 | 30,000 |
| Elongation - % in 2" | 16 | 12 | 10 | 8 |
| Brinell Hardness (10 MM Ball-500 Kg) load-30 sec) | 40 | 50 | 55 | 60 |
| Compression Deformation Limit #/in$^2$* | 9,750 | 11,000 | 11,800 | 14,100 |
| Charpy Impact Ft.-lbs. | 2.2 to 2.6 | 2.2 to 2.6 | 2.2 to 2.6 | 2.2 to 2.6 |
| Modulus of Elasticity #/in$^2$ | 10,000,000 12,000,000 | 10,000,000 12,000,000 | 10,000,000 12,000,000 | 10,000,000 12,000,000 |
| Modulus of Rigidity #/in$^2$ | 3,000,000 | 3,500,000 | 3,700,000 | 4,000,000 |
| Electrical Conductivity (% Copper at room | 14.8 | 10.4 | 9.1 | 8.7 |

-continued

| MECHANICAL PROPERTIES OF BEARIUM T METALS | GRADES | | | |
|---|---|---|---|---|
| | B-4 | B-8 | B-10 | B-11 |
| temperature) | | | | |
| Coefficient of Friction-Dry** | .13 | .14 | .16 | .18 |
| Thermal Conductivity: | | | | |
| CGS Units at Room Temperature CAL/cm$^2$/cm/sec/°C. | .138 | .097 | .085 | .080 |
| British Units at Room Temperature BTU/ft$^2$/ft/hr/°F. | 33.4 | 23.4 | 20.4 | 18.5 |
| Specific gravity | 9.4 | 9.3 | 9.2 | 9.1 |
| Weight per cubic inch | .334 | .324 | .320 | .312 |

*Lead producing a permanent set of .001" in sample 1" high
**As determined on Amsler wear test machine
Coefficient of Expansion for all grades of Bearium T Metal .000011"
Coefficient of Contraction (for range from 70° F. to −115 F.) .000011"
(for range from 70° F. to −330° F.) .0000087"
(Coefficient figures shown are per inch per degree Fahrenheit)

While we have shown and described several embodiments, with attendant alternative structures, in accordance with the present invention, it is understood that the same are not limited thereto but are susceptible to numerous changes and modifications as known to one having ordinary skill in the art, and we therefore do not wish to be limited to the details shown and described herein, but intend to cover all such modifications as are encompassed by the scope of the appended claims.

We claim:

1. Apparatus for an internal combustion engine having a pressure source for generating pressure in response to operation of said engine and having at least one cylinder with a first longitudinal axis and having a yoke with a slot having a second axis substantially orthogonal to the first axis comprising first bearing means mounted to the crankcase and engaging at least one first surface of the yoke for stabilizing the position of the yoke for movement parallel to said first axis, the second axis during movement of the yoke along the first axis intersecting the means mounted to the crankcase and a second bearing means movably received in and extending from the crankcase, said second bearing means through its range of movement engaging and applying a force to a second surface on the yoke opposite the first surface in response to said pressure received by said second bearing means from said pressure source, said source comprising means responsive to a lubricant pressure generated by the internal combustion engine to generate the force applied to the second surface of the yoke.

2. Apparatus for stabilizing the position of a yoke and piston within a crankcase and cylinder of an internal combustion engine, the engine having a pressure source for generating a pressure only while the engine is in operation comprising a bearing surface on said crankcase and, a member having at least a surface movable with respect to said crankcase, said surface being responsive to a lubrication pressure generated by said pressure source for applying a force to the yoke to maintain pressure of a surface of the yoke against said bearing surface of the crankcase. mounted to the crankcase at at least two spaced locations along a line parallel to the line of intersection of its planar surfaces and means for applying substantially equal pressure from said pressure source to said V-way means at said at least two spaced locations.

3. Apparatus in accordance with claim 2, for stabilizing the position of a yoke and piston within a crankcase and cylinder of an internal combustion engine, the cylinder having an axis, wherein said bearing surface and said member comprises respectively first and second V-way means mounted to opposite sides of the crankcase, each of said V-way means comprising at least a pair of intersecting planar surfaces, the line of intersection of the planar surfaces being parallel to the cylinder axis and means mounted to the yoke having corresponding planar surfaces and engaging the planar surfaces of the V-way means for preventing rotation of the yoke about the cylinder axis means for applying substantially equal pressure to said plural movably mounted V-way means from a common pressure source.

4. Apparatus in accordance with claim 2, for stabilizing the position of a yoke and piston within a crankcase and cylinder of an internal combustion engine, the cylinder having an axis, wherein said bearing surface and said member comprise respectively first and second V-way means mounted to opposite sides of the crankcase, each of said V-way means comprising at least a pair of intersecting planar surfaces, the line of intersection of the planar surfaces being substantially parallel to the cylinder axis and, means mounted to the yoke having corresponding planar surfaces and engaging the planar surfaces of the V-way means for preventing rotation of the yoke about the cylinder axis wherein at least said second of said V-way means is mounted to said crankcase for movement substantially orthogonal with respect to the cylinder axis, the apparatus further comprising means responsive to a pressure generated by a pressure source for applying a force to said movably mounted V-way means to effect engagement of the surface of the movably mounted V-way means with the yoke.

5. Apparatus in accordance with claim 4, further comprising lubricant channel means lying in at least a second of said planar surfaces of said V-way means, and at least one aperture for transmitting lubricant to said lubricant channel means from a lubricant source.

6. Apparatus in accordance with claim 4, wherein at least one of said first and second V-way means is mounted to the crankcase at at least two spaced locations along a line parallel to the line of intersection of its planar surfaces and means for applying substantially equal pressure from said pressure source to said V-way means at said at least two spaced locations.

7. Apparatus for stabilizing the position of a yoke and piston within a crankcase and cylinder of an internal combustion engine, the cylinder having a first axis and the engine having a pressure source, comprising a bearing member in sliding contact with and extending from said crankcase comprising a surface engaging a first surface on said yoke substantially parallel to said first axis and responsive to a pressure generated by the pressure source only during engine operation for applying a force to the yoke to effect engagement of a second surface of the yoke located opposite to and spaced from said first surface with a bearing surface on the crankcase, and means responsive to said pressure generated by the pressure source for reducing wear on the yoke and at least one surface in contact with the yoke comprising means for transmitting substantially continuous lubrication to surfaces on and in contact with the yoke, said pressure source being formed by pressure flow from said means for transmitting substantially continuous lubrication.

8. Apparatus in accordance with claim 7 further comprising containing means mounted to one of two parts consisting of the crankcase and the yoke having an aperture of substantially uniform cross section along an axis which is parallel to the first axis, and a peg means mounted to the other of the two parts and having uniform cross section along an axis parallel to the first axis and engaging the containing means for restraining the movement of the yoke in two different directions, both directions being substantially orthogonal with respect to the first axis.

9. Apparatus in accordance with claim 8 wherein the containing means is of ring-like configuration.

10. Apparatus in accordance with claim 8 further comprising means mounted on one of the crankcase and the yoke for supporting the containing means at a distance from the one of the crankcase and yoke to which the containing means is mounted.

11. Apparatus in accordance with claim 7 further comprising a sliding block engaging the yoke, and a crank throw mounted within the sliding block, a port means pressure responsive to at least said pressure source and wherein the means for transmitting substantially continuous lubrication comprises means for transmitting substantially continuous lubrication pressure from the port means to at least a bearing between the yoke and sliding block.

12. Apparatus in accordance with claim 11, wherein the means for transmitting substantially continuous lubrication pressure comprises at least one lubrication channel means in the sliding block receiving lubrication under substantially continuous pressure at all rotational positions of the crank throw for delivering lubrication to at least one bearing surface of the sliding block juxtaposed to the yoke.

13. Apparatus in accordance with claim 11, wherein the means for transmitting substantially continuous lubrication pressure comprises cross channel means for distributing lubrication under substantially continuous pressure across the engaging surfaces of the yoke and the sliding block.

14. Apparatus in accordance with claim 11 wherein the means for transmitting substantially continuous lubrication pressure comprises means for distributing lubrication under continuous pressure to at least one side of the yoke.

15. Apparatus for an internal combustion engine having at least one cylinder with a first axis and an attendant crankcase with crankshaft mounted therein for rotation of a throw of the crankshaft, comprising a piston disposed in the cylinder for movement along the first axis, a yoke connected to the piston for movement along the first axis, the yoke having at least a surface substantially parallel to a second axis substantially orthogonally disposed with respect to the first axis, a sliding block to engage said surface for movement along the second axis, the sliding block having a bore receiving the crankshaft throw, and means for stabilizing the position of the yoke for movement along said first axis including at least one bearing means on said yoke disposed in a plane, which plane intersects the second axis during movement of the yoke for establishing and stabilizing the position of the yoke within the crankcase during its movement along the first axis, means mounted to the crankcase for engaging the bearing means, and bearing shoe means received for movement in and relative to the crankcase extending therefrom and applying a force for causing the bearing means to apply pressure against the crankcase at a location opposite to and spaced from that of said at least one bearing means, said bearing shoe means further comprising means responsive to a pressure generated by the engine only during engine operation for maintaining the yoke and the bearing means in contact with the crankcase, said pressure being generated by a means for transmitting substantially continuous lubrication to said engine.

16. Apparatus in aocordance with claim 15 wherein the sliding block comprises shoulder means for retaining and centering the sliding block on the crank throw.

17. Apparatus in accordance with claim 15 wherein the sliding block comprises means for preventing rotation of the yoke about the first axis comprising at least one recess for engaging a surface on the yoke.

18. An internal combustion engine in accordance with claim 15 having multiple cylinders.

19. An internal combustion engine in accordance with claim 15 having a two-stroke cycle.

20. An internal combustion engine in accordance with claim 15 having a four-stroke cycle.

21. An internal combustion engine in accordance with claim 15 constructed for fuel injection operation.

22. Apparatus in accordance with claim 15 wherein the sliding block has at least one bearing surface engaging at least one bearing surface on the yoke, the bearing surface of the sliding block being constituted by a first material different from a second material of the bearing surface of the slot in the yoke engaged by the bearing surface of the sliding block.

23. Apparatus in accordance with claim 22 wherein one of said materials comprises BEARIUM ® metal.

24. Apparatus according to claim 15 further comprising means for preventing rotation of said yoke about the first axis.

25. Apparatus according to claim 24, wherein the means for preventing rotation of the yoke about the first axis comprises ridge means substantially parallel to the first axis mounted to one of two parts consisting of the bearing shoe means and the yoke and a channel means substantially parallel to the first axis mounted to the other of the two parts for receiving the ridge means.

26. Apparatus according to claim 24, wherein the means for preventing the rotation of the yoke about the first axis comprises ridge means substantially parallel to the first axis mounted to one of two parts consisting of the crankcase and the yoke and channel means substantially parallel to the first axis mounted to the other of the two parts for receiving the ridge means.

27. Apparatus in accordance with claim 15 wherein the bearing means comprises a member mounted to the yoke and under tension for transmitting a force to the crankcase of a greater magnitude during a compression stroke than during a non-compression stroke.

28. Apparatus in accordance with claim 27 further comprising means mounted to the crankcase and juxtaposed to the member for engaging at least one bearing surface of the member, the bearing surface of the means mounted to the crankcase being of a first material different from a second material of the bearing surface of the member.

29. Apparatus in accordance with claim 28 wherein one of said materials is BEARIUM ® metal.

30. Apparatus in accordance with claim 15 wherein the bearing means comprises a member mounted to the yoke and under tension for transmitting a force to the crankcase of a greater magnitude during a non-compression stroke than during a compression stroke.

31. Apparatus in accordance with claim 30 further comprising means mounted to the crankcase and juxtaposed to the member for engaging at least one bearing surface of the member, the bearing surface of the means mounted to the crankcase being of a first material different from a second material of the bearing surface of the member.

32. Apparatus in accordance with claim 31 wherein one of said materials is of BEARIUM ® metal.

* * * * *